US009073657B2

(12) United States Patent
Austermeier et al.

(10) Patent No.: US 9,073,657 B2
(45) Date of Patent: Jul. 7, 2015

(54) LABELER AND METHOD FOR LABELING

(71) Applicant: Multivac Marking & Inspection GmbH & Co. KG, Enger (DE)

(72) Inventors: Georg Austermeier, Hövelhof (DE); Tanja Jansen, Salzbergen (DE)

(73) Assignee: MULTIVAC MARKING & INSPECTION GMBH & CO. KG, Enger (DE)

( * ) Notice: Subject to any disclaimer, the term of this patent is extended or adjusted under 35 U.S.C. 154(b) by 93 days.

(21) Appl. No.: 13/899,002

(22) Filed: May 21, 2013

(65) Prior Publication Data

US 2013/0312893 A1 Nov. 28, 2013

(30) Foreign Application Priority Data

May 22, 2012 (EP) ..... 12003976

(51) Int. Cl.
*B65C 9/02* (2006.01)
*B65C 9/18* (2006.01)
*B65C 9/36* (2006.01)

(52) U.S. Cl.
CPC ..... *B65C 9/02* (2013.01); *Y10T 156/1712* (2015.01); *Y10T 156/10* (2015.01); *Y10T 156/1097* (2015.01); *Y10T 156/171* (2015.01); *B65C 9/1884* (2013.01); *B65C 9/36* (2013.01)

(58) Field of Classification Search
CPC ..... B65C 1/021; B65C 9/1876; B65C 1/02; B65C 9/1884; Y10T 156/1097; Y10T 156/171
USPC ..... 156/302, 542, 249
See application file for complete search history.

(56) References Cited

U.S. PATENT DOCUMENTS

| | | | | |
|---|---|---|---|---|
| 5,300,181 | A * | 4/1994 | Yamaguchi | 156/542 |
| 5,725,717 | A * | 3/1998 | Harte et al. | 156/299 |
| 7,318,877 | B2 * | 1/2008 | Harte | 156/249 |
| 7,832,440 | B2 * | 11/2010 | Richardson et al. | 156/350 |
| 2004/0250960 | A1 | 12/2004 | Harte et al. | |
| 2009/0199961 | A1 * | 8/2009 | Georg | 156/230 |

FOREIGN PATENT DOCUMENTS

| | | | |
|---|---|---|---|
| DE | 102008007890 | A1 | 8/2009 |
| EP | 1177982 | A1 | 2/2002 |

* cited by examiner

*Primary Examiner* — Philip Tucker
*Assistant Examiner* — John Blades
(74) *Attorney, Agent, or Firm* — Husch Blackwell LLP

(57) ABSTRACT

The invention relates to a labeler and a method for applying labels onto an article strip, wherein a transfer device is moved continuously when said labels are pressed on and a lifting device of said transfer device comprises a height-adjustable actuator.

12 Claims, 5 Drawing Sheets

LABELER AND METHOD FOR LABELING

CROSS-REFERENCE TO RELATED APPLICATIONS

This Application claims priority to European Application Number 12003976.3 filed May 22, 2012, to Georg Austermeier and Tanja Jansen entitled "Labeler and Method for Labeling," currently pending, the entire disclosure of which is incorporated herein by reference.

FIELD OF THE INVENTION

The invention relates to a labeler as well as to a method for labeling.

BACKGROUND OF THE INVENTION

A labeler is known from DE 10 2008 007 890 A1 for applying labels in rows on a film sheet. In this, the labeler is arranged on a thermo-forming packaging machine downstream of a sealing station, and it can apply the labels from the top onto a cover film, or from below onto the bottom surface of a formed lower film of a pack. The film strip comprises a plurality of tracks and a plurality of rows of packs. A transfer device of the labeler picks up a number of labels from a label dispenser, while a lifting device of the transmission device is in a first position spaced from the film strip. The transfer device is subsequently moved by means of a travel device to the position where the number of labels picked up is to be applied onto the film strip.

The pneumatically operated lifting device then transfers the labels to the film strip and presses them on to the film strip, so that the labels remain securely adhered to the film strip. The film strip may be a lower film or a top film, and is hereinafter also referred to as the article strip. A vertical pressing position is adjusted by the duration which the pneumatic lifting device is supplied with compressed air. Additionally, the volume flow and thereby the lifting speed can be adjusted by means of a throttle.

The pressing force results from a target position of the lifting device and the position of the film strip onto which the labels are attached. Since the film strips are flexible in the direction of the pressing force, the flexibility together with the deflection of the film strips by the lifting device during the pressing process corresponds to the pressing force. Adjustment of the stroke and the target position, respectively, due to the changing environmental conditions is imprecise and inflexible for differing pack depths, since the volume flow, the duration and pressure applied by the pneumatic lifting device interact. By reducing the volume flow, the target position can be set with a little more accuracy using the duration of the supply of compressed air, but the slower lifting movement reduces the performance of the of the labeler. Fluctuating pressure in the supply line changes the lifting movement or the target position, respectively, without the operator or the machine controls being able to control these conditions.

When using spring-loaded pressing elements that press the labels onto the film strip, variations in the lifting movement or the target position, respectively, can be compensated. However, variations or improvements in an initial setting to accommodate for different pack depths does not currently exist.

During the movement of the transfer device by means of travel device on a thermo-forming packaging machine, security/safety clearances must be observed as this movement of the transfer device generates high kinetic energy and therefore correspondingly high security/safety clearances are to be observed. These high security/safety clearances require a corresponding high demand in physical space occupied by existing thermo-forming packaging machine of this construction.

SUMMARY OF THE INVENTION

It is the object of the present invention to provide a labeling machine enabling precise and easily adjustable target positions at high performance and/or reducing the mechanical load.

The labeler according to the invention may comprise a label dispenser, a travel device, a controller and a transfer device for transferring a row of labels dispensed to the transfer device onto an article strip, where the transfer device has lifting device disposed vertically in relation to the article strip. The travel device can comprise a motor and is intended to continuously move the transfer device parallel to the article strip during the transfer of a plurality of rows of labels, and the lifting device comprises a height-adjustable actuator for moving pusher plates. This enables predetermining an exact target position and different pack depths can be adjusted by means of a single parameter via the controller. By transferring the labels onto the article strip with continuous movement of the transfer device along the article strip, the maximum speed of the transfer device and also the accelerations can be reduced while maintaining the same performance of the labeler. This reduces the mechanical loads of the labeler, since the label dispenser and the transfer device possibly have high masses. In one embodiment, the speed of the transfer device is reduced when pressing the labels onto the article strip, but the travel device is not halted, enabling the labeling procedure to run in a steady and continuous manner.

The motor of the travel device and the actuator can be movable in an interpolating manner using a controller so that the labeler has to be accelerated less, and to be able to reduce the maximum travel speed, and wherein the performance in applying the labels within a predetermined time can be upheld. Interpolated movability of the motor of the travel device and the actuator of the transmission device, or of the motor of the travel device and the lifting device of the transmission device, means, that the motor and the actuator or the motor and the lifting device, respectively, are controlled by the controller so that the target positions of the motor and the actuator, or the motor and the lifting device, at any given point are respectively computationally offset against one another. Interpolated movablility/movement provides for a continuous overlapped smooth movement of the transfer device in vertical and horizontal directions along the labeling route as illustrated in FIG. 5*b* . The target value for controlling the motions interfering with one another may be in maintaining a speed as constant as possible and as low as possible when pressing-on the labels.

The actuator can be a motor and, in one embodiment, is a stepper motor. Performance of the labeler can be further increased and is independent of external factors such as a compressed air supply in the factory hall.

In one embodiment, a lifting force, a lifting speed and/or a lifting height of the lifting device are adjustable by means of parameters via the controller in order to reduce the load on the labeler due to the continuous movement of the transfer device or to increase performance of the labeler due to the simultaneously occurring movement of the transfer device and the lifting device.

The transfer device can comprise spring-loaded pusher plates enabling a defined pressing force.

The pusher plates may include spring-loaded pusher pins supporting the pressing-on action of labels onto pack bottoms having an uneven surface.

Preferably, the transfer device is movable by means of the travel device in a longitudinal or transverse direction relative to the transport direction of the article strip. Furthermore, the labeler can be provided above and/or below the article strip for applying labels from the top and/or the bottom onto the article strip.

In one embodiment, the pressing force can be limited by means of the lifting power or the torque of the stepper motor, in order to increase safety for man and machine in case of defect or an incorrectly adjusted machine.

The use of a labeler according to the invention on thermo-forming packaging machines can occur between a sealing station and a cutting station for applying the labels from above onto the top film and/or from below onto the underside of the pack bottom side of the lower film.

In one embodiment, a method according to the invention for multi-track and multi-row application of labels on an article strip comprises the following steps:

- picking up labels from a label dispenser by means of a transfer device,
- moving the transfer device in parallel to (i.e. along) the article strip by means of a travel device in or against the direction of transport,
- moving the pusher plates by means of a lifting device of the transfer device towards the article strip,
- pressing the labels onto the article strip by means of the pusher plates,
- moving the pusher plates by means of the lifting device away from the article strip,
- wherein the labels are pressed on a package during a continuous movement of the travel device. In this manner, the travel device has more time available for movement of the transfer device at the same performance of the labeler, so that accelerations and speed can be reduced in order to reduce the mechanical load. Continuous movement of the travel device means that the travel device does not interrupt its movement in or against the direction of transport when the labels are pressed on. Consequently, the transfer device maintains a direction component of motion parallel to the article strip due to the travel device while the labels are pressed on, and in particular the component of motion being one of in or against the direction of transport.

Moving the transfer device and moving the pusher plates is preferably performed in an interpolating manner A motor, for example a step motor, can be provided for moving the lifting device.

In one embodiment, a lifting force, a lifting speed and/or a lifting height of the lifting device can be adjusted via a controller.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Identical components are designated throughout the figures with the same reference numerals.

DETAILED DESCRIPTION OF THE INVENTION

Figure 1:
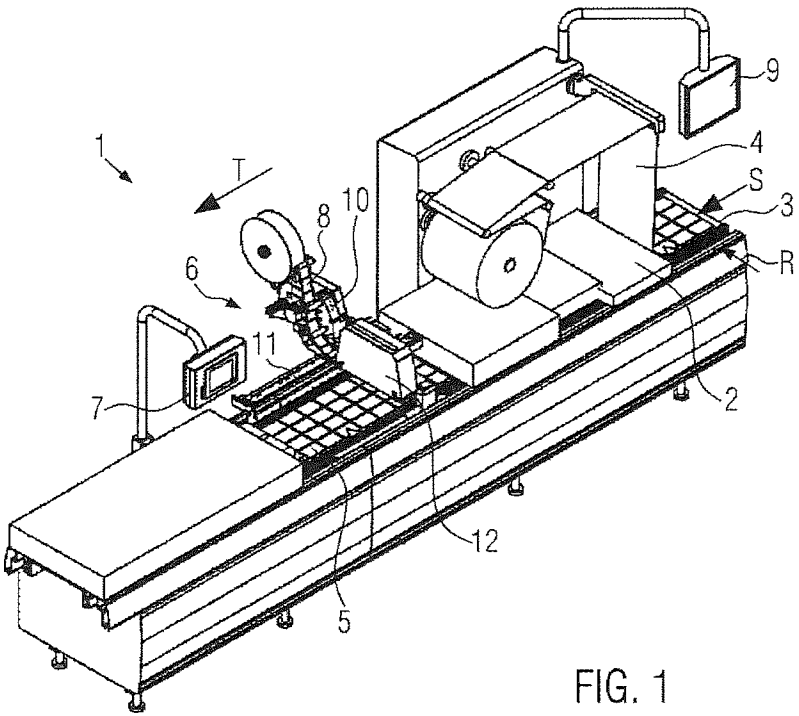
FIG. 1 is a top perspective view of a thermo-forming packaging machine with a labeler according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a section of a thermo-forming packaging machine 1 with a sealing station 2, into which a lower film 3 and a top film 4 are fed for producing packs 5. In the sealing station 2, twelve packs 5 divided into four tracks S and three rows R can be sealed in one work cycle. A labeler 6 according to the invention with a controller 7 is disposed in the transport direction T downstream of the sealing station 2 for applying labels 8 to the twelve packs 5 from above onto the top film 4. The controller 7 of the labeler 6 can also be integrated into the controller 9 of the thermo-forming packaging machine 1. The labeler 6 comprises a label dispenser 10, a travel device 11 and a transfer device 12.

Figure 2:
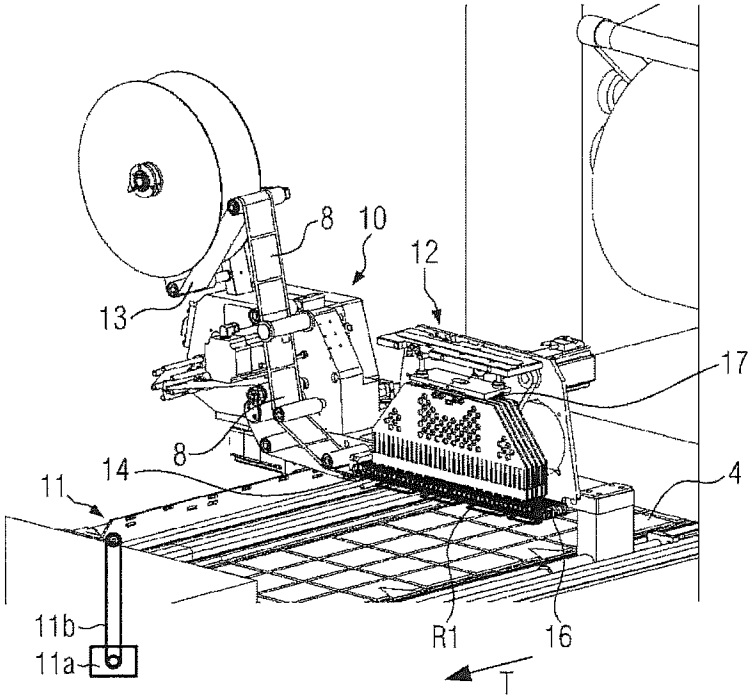
FIG. 2 is an enlarged top perspective view of the labeler in a first position according to one embodiment of the present invention.

FIG. 2 shows the label dispenser 10 with a carrier strip 13 for labels 8, where the labels 8 are removed from a dispensing edge 14 of the carrier strip 13 and transferred to the transfer device 12. The transfer device 12 is for better representation shown without a casing. By means of negative pressure generated by a fan, not shown, the labels 8 are with their non-adhesive top side held on conveyor belts 16, while a first row R1 of labels 8 is picked up with the number of tracks S from the transfer device 12. During this phase, a lifting device 17 of the transfer device 12 is in a pick-up position. In order to apply the row R1 of labels 8 downwardly onto the top film 4, the travel device 11 moves the label dispenser 10 with the transfer device 12 in or against the transport direction T to the position in which the row R1 of labels 8 is applied from above to the top film 4 The drive for the travel device 11 is embodied by a schematically illustrated motor 11*a*, for example a servo motor or stepper motor, and a toothed belt drive 11*b*. The transfer device 12, however, can also be positioned above the first row of packs 5, while the first row R1 of labels 8 is picked up.

Figure 3:
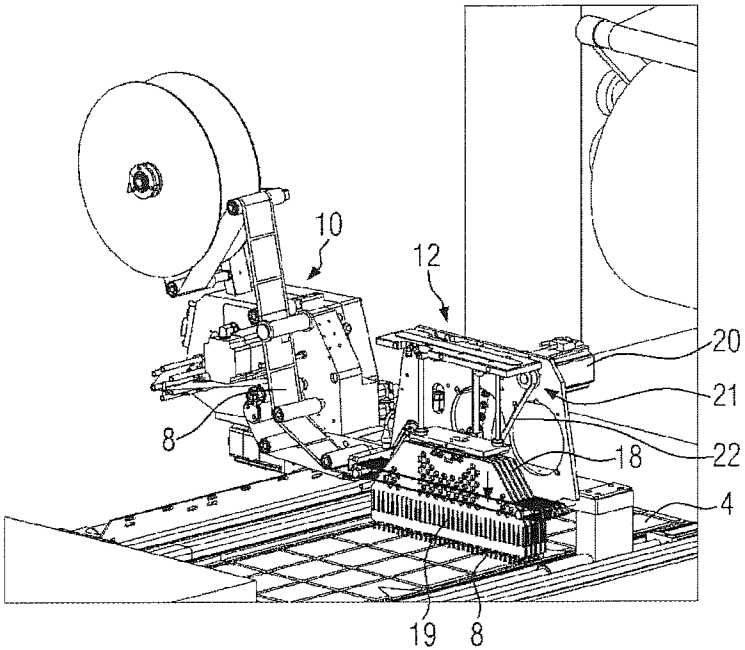
FIG. 3 is an enlarged top perspective view of the labeler of FIG. 2 in a target position according to one embodiment of the present invention.

FIG. 3 shows the phase in which the lifting device 12 comprising the pusher plates 18 with spring-loaded pins 19 has been moved so far down that the labels 8 were lifted off by the pusher pins 19 from the conveyor belts 16 and the pressed onto the top film 4. In this, the pusher plates 18 are moved by means of a stepping motor 20 and a belt gear 21 to this target position. This can be adjusted by the operator such that an optimal and pre-defined pressing force is generated by means of the spring-loaded pusher pins 19 for pressing-on the labels 8.

Figure 4:
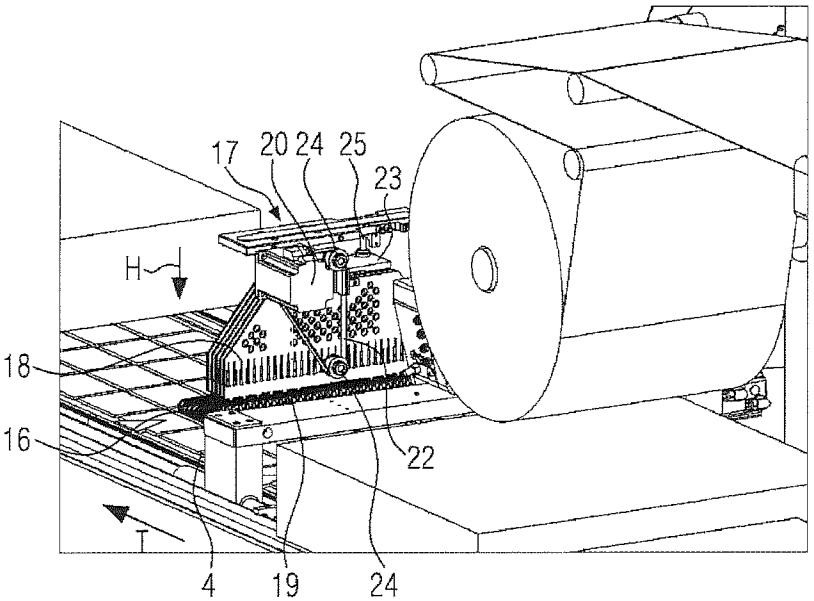
FIG. 4 is a rear perspective view of a labeler with a lifting drive according to one embodiment of the present invention.

FIG. 4 shows the design of the lifting device 17 in the perspective in the transport direction T. The stepping motor 20 transmits its rotational movement and its torque to a belt 22 which is connected to a base plate 23. By means of two guide rollers 24 and guides 25 for the base plate 23, the rotational movement of the stepping motor 20 is converted into a vertical movement of the base plate 23. The pusher plates 18 are distanced to one another far enough in order to be able to pass between the transport belts 16, thereby picking up the labels 8 from the conveyor belt 16 and applying them to the top film 4. In this embodiment shown, the pusher plates 18 comprise pusher pins 19, which are embodied in a spring-loaded manner in the lifting direction H.

The method of the present invention is described as follows. After depositing the first row R1 of labels 8, the lifting device 12 again returns to the pick-up position in that the pusher plates 18 are moved vertically upwards in order to pick up a new row R2 of labels 8 from the dispensing unit 10 in order to then apply them to a neighboring row R2 of the packs previously provided with labels 5 or to the top film 4, respectively. For this, the travel device 11 moves the label dispenser 10 with the transfer device 12 in or against the transport direction T to this new position. This process is repeated according to the number of rows R to be labeled in a single work cycle. In order to reduce high accelerations and speeds during the movement of the label dispenser 10 together with the transfer device 12, and thereby to also increase the lifetime and to reduce the mechanical loads on the labeler 6, respectively, the labels 8 are deposited and pressed onto the top film 4 when the travel device 11 is activated and thereby a continuous movement of the transfer device 12 is effected. This means, that the label dispenser 10 together with the transfer device 12 is not halted for depositing the labels 8, but further moved until the work cycle is completed by setting down the last row R3 of labels 8.

Alternatively or additionally, a respective labeler 6 can also be disposed below the lower film 3 in order to apply labels 8 on the bottom surface of the lower film 3 of the packs 5 in a manner analogous to the method described above. For packs 5 being formed having differing depths, the target position of the lifting device 17 can be entered via a parameter into the controller 7 and be stored in a program. It is also possible to adapt the speeds and accelerations of the travel device 11 and the lifting device 12 such that at maximum power or at a minimum time for a work cycle, respectively, the mechanical load on the labeler 6 can be reduced due to lower accelerations and speeds. Throughout the entire work cycle, the top film 4 and the lower film 3 are at rest.

Figure 5A:
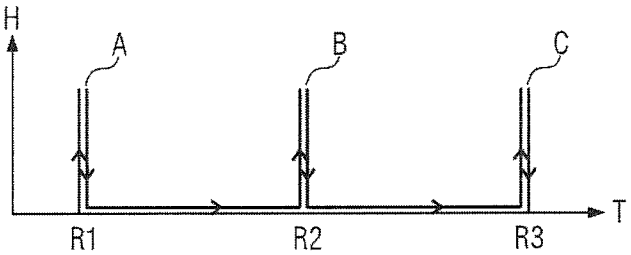
FIG. 5a (Prior art)
FIG. 5*a* is a motion diagram for the movement of the travel device and the lifting movement of the transfer device according to prior art.

FIG. 5*a* in a graph shows the movement of a transfer device 12 according to prior art having a pneumatically driven lifting device 17 and a motor-driven travel device 11. The vertical coordinate axis of the graph shows the vertical movement of the lifting device H and the horizontal coordinate axis shows the movement of the travel device 11 in the transport direction T for three rows R1, R2, R3 to be labeled. Due to the varying target position which was only inaccurately adjustable, a row of labels 8 could only be deposited when the travel device 11 was stopped at the target positions A, B, C.

Figure 5B:
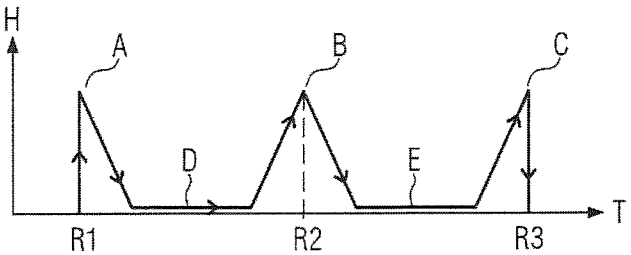
FIG. 5*b* is a motion diagram for the movement of the travel device and the lifting movement of the transfer device according to one embodiment of the present invention.

FIG. 5*b* shows the movements according to the method of one embodiment of the present invention in a diagram with a lifting device 17 comprising a motor drive 20. Due to the fact that the target position A, B, C for depositing the rows R1, R2, R3 of labels 8 is exactly approachable, the movement of the transfer device 12 from one row to the next does not need to be interrupted or stopped while the labels are deposited 8. In the section D or E, respectively, of the travel route of the transfer device 12, new labels are picked up from the label dispenser 10 for the following rows R2 or R3, respectively.

During the same time interval between two depositing processes, the speed of the movement between the rows and the movement during the depositing process can be reduced in order to subsequently increase the speed again. This adjustment results in less acceleration and a reduced maximum speed during the movement of the label dispenser 10, and the transfer device 12. With three rows to be labeled R1, R2, R3, this is evident only for the center row R2, since the transfer device 12 is at the beginning of the work cycle already positioned at the first or the last row. It is likewise conceivable that the speed of the transfer device 12 across the travel distance from A to C is constant and corresponds to the time that is determined as being available to the packaging machine for the labeling process.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A labeler comprising:

a label dispenser;

a controller;

a transfer device for transferring a row of labels dispensed to said transfer device onto an article strip, said transfer device including a lifting device having a height-adjustable actuator for moving pusher plates, wherein said lifting device is configured for acting vertically in relation to said article strip; and a travel device including a motor, wherein said controller is configured to continuously move said travel device during the transfer of a plurality of rows of labels, and said travel device controlled to continuously move said transfer device parallel to said article strip during the transfer of a plurality of rows of labels.

2. The labeler according to claim 1, wherein said motor of said travel device and said actuator of said transfer device are interpolateably movable by said controller.

3. The labeler according to claim 1, wherein said actuator is a stepper motor.

4. The labeler according to claim 1, wherein a lifting force, a lifting speed and/or a lifting height of said lifting device are adjustable by parameters via said controller.

5. The labeler according to claim 1, wherein said pusher plates are spring-loaded pusher plates.

6. The labeler according to claim 5, wherein said pusher plates comprise spring-loaded pusher pins.

7. The labeler according to claim 1, wherein said transfer device is movable by said travel device in a longitudinal or transverse direction relative to a transport direction of said article strip.

8. The labeler according to claim 3, wherein a pressing force of said transfer device can be limited by a lifting force of said stepper motor.

9. A method for multi-track and multi-row application of labels onto an article strip comprising the following steps:

picking up said labels from a label dispenser by a transfer device;

moving said transfer device in parallel to said article strip by a travel device;

moving pusher plates by a lifting device of said transfer device towards said article strip;

pressing said labels onto said article strip; and moving said pusher plates by said lifting device away from said article strip;

wherein pressing-on said labels is effected during a continuous movement of said travel device.

10. The method according to claim 9, wherein the movement of said transfer device and a movement of said pusher plates is conducted in an interpolating manner.

11. The method according to claim 9, wherein a stepper motor is provided for movement of said lifting device.

12. The method according to claim 9, wherein a lifting force, a lifting speed and/or a lifting height of said lifting device are adjusted via a controller.

* * * * *